US008110781B2

(12) United States Patent
Kuo

(10) Patent No.: US 8,110,781 B2
(45) Date of Patent: Feb. 7, 2012

(54) GOLF CLUB HEAD COVER WITH TEMPERATURE CONTROLLING DEVICE

(76) Inventor: KuangHung Kuo, Taipei (TW)

( * ) Notice: Subject to any disclaimer, the term of this patent is extended or adjusted under 35 U.S.C. 154(b) by 890 days.

(21) Appl. No.: 12/215,554

(22) Filed: Jun. 27, 2008

(65) Prior Publication Data

US 2009/0008008 A1 Jan. 8, 2009

(51) Int. Cl.
*H05B 1/02* (2006.01)

(52) U.S. Cl. ..... 219/494; 219/506; 219/497; 219/535; 206/315.4

(58) Field of Classification Search ..... 219/494, 219/497, 501, 505, 528, 535; 206/315.2, 206/315.4
See application file for complete search history.

(56) References Cited

U.S. PATENT DOCUMENTS 3,683,155 A * 8/1972 Loofbourow et al. ..... 219/521
5,062,528 A * 11/1991 Whitaker, Jr. ..... 206/315.3
5,860,415 A * 1/1999 Waters ..... 126/680
2008/0272104 A1* 11/2008 Farrington ..... 219/201

* cited by examiner

*Primary Examiner* — Mark Paschall
(74) *Attorney, Agent, or Firm* — Raymond Y. Chan; David and Raymond Patent Firm

(57) ABSTRACT

The present invention provides a golf club head cover which provides conventional protection to golf clubs and in addition provides a heating function for a hitting surface of the golf club in order to keep the temperature within a optimized range for hitting. The golf club head cover has a main housing having an opening side for inserting a top portion of the golf club and a heating side for disposing a temperature controlling device for heating. The temperature controlling device has a power source, a circuit board, and a heating plate which couples with the hitting surface of the top portion of the golf club to apply heat to control the temperature.

20 Claims, 11 Drawing Sheets

GOLF CLUB HEAD COVER WITH TEMPERATURE CONTROLLING DEVICE

BACKGROUND OF THE PRESENT INVENTION

1. Field of Invention

The present invention relates to a golf club, and more particularly to a golf club head cover for a golf club comprising a temperature controlling device adapted to maintain the temperature of the golf club at a certain desired temperature within the golf club head cover.

2. Description of Related Arts

Golfing is an extremely popular sport nowadays. The golf clubs and other equipments are expensive, thus cares and maintenances are required while using and storing these equipments. The golf clubs are inserted into the golf club head covers for protection while not in used or when they are stored at home or inside a car. The hitting surface of the head of the golf clubs is very critical for performance, thus the golf clubs are inserted into the golf club head cover for protection. During a regular golf games, players are required to travel along the golf courses for approximately 4 to 5 hours and the golf clubs are stored safely. Conventional golf club head covers come in many shapes and sizes and provide sufficient protections for different golf clubs.

It is a proven fact that the temperature of the hitting surface of the golf club provides extra driving distance for the drive. This result is obvious when using the driver for hitting long distance drive. The best result is to keep the hitting surface of the driver within a temperature range of 43° C. to 55° C. While conventional golf club head covers provide physical protections for the golf clubs, they do not provide any heating function for the hitting surface of the golf club especially in a cold environment.

SUMMARY OF THE PRESENT INVENTION

A main object of the present invention is to provide a golf club head cover for a golf club which comprises a temperature controlling device for maintaining the golf club head at a predetermined temperature so as to allow the golf club to achieve the best performance for a hitting a golf ball.

Another object of the present invention is to provide a golf club head cover for a golf club comprising a temperature controlling device for heating up a hitting surface of the golf club at an elevated temperature, wherein the golf club head cover is readily portable so that the user is able to maintain the golf club at the optimal elevated temperature in a wide variety of circumstances. In other words, the present invention is capable of promoting widespread applications.

Another object of the present invention is to provide a golf club head cover for a golf club which has a simple electrical structure for providing a heat source to control the temperature so that the golf club is in its best condition for hitting a golf ball.

Another object of the present invention is to provide a golf club head cover for a golf club which does not involve complicated mechanical structure so as to minimize the manufacture cost of the present invention.

Accordingly, in order to accomplish the above objects, the present invention provides a golf club head cover for a golf club comprising a golf club head having a hitting surface for hitting a golf ball, comprising:

a main housing having a cavity and a heating pocket provided within the cavity, wherein the golf club head is adapted to be fittedly disposed within the cavity to align the hitting surface with the heating pocket; and a temperature controlling device, which comprises:

a heating plate disposed within the heating pocket to substantially align with the hitting surface of the golf club head; and a power source supported by the golf club head cover to electrically connect with the heating plate, wherein when the power source is activated, the heating plate is arranged to be heated up by the power source, wherein heat generated by the heating plate is transferred to the hitting surface of the golf club head through the heating pocket so as to heat up and maintain the hitting surface to an elevated temperature for achieving an optimal performance when the hitting surface hits a golf ball.

DETAILED DESCRIPTION OF THE PREFERRED EMBODIMENT

Figure 1:
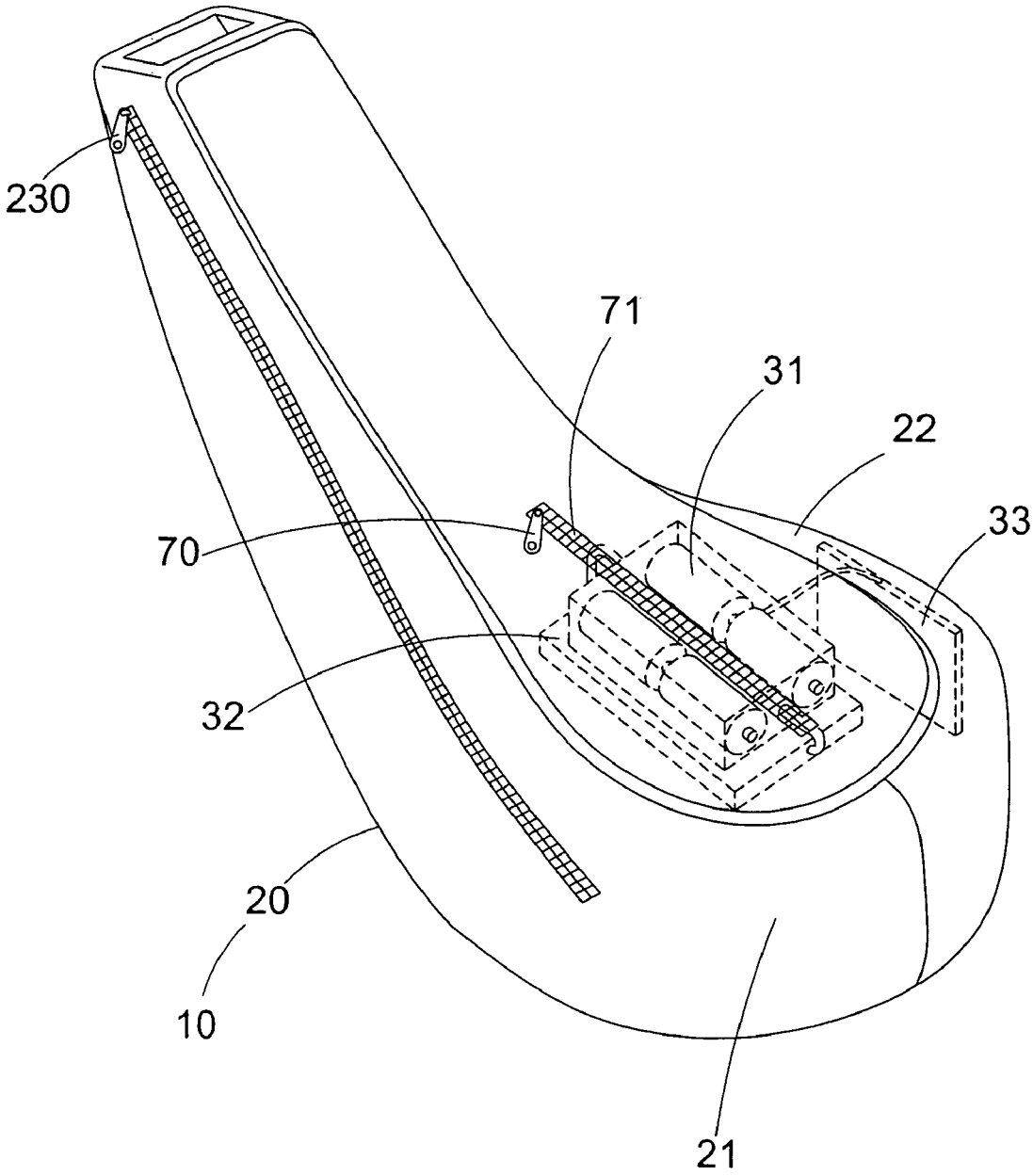
FIG. 1 is a perspective view of the golf club head cover according to a preferred embodiment of the present invention.

Referring to FIG. 1 to FIG. 8 of the drawings, a golf club head cover 10 for a golf club 50 comprising a golf club head having a hitting surface 51 for hitting a golf ball according to a preferred embodiment of the present invention is illustrated, in which the golf club head cover 10 comprises a main housing 20 and a temperature controlling device 30.

The main housing 20 has a cavity 21 and a heating pocket 24 provided within the cavity 21, wherein the golf club head is adapted to be fittedly disposed within the cavity 21 to align the hitting surface 51 with the heating pocket 24.

The temperature controlling device 30 comprises a heating device which comprises heating plate 33 disposed within the heating pocket 24 to substantially align with the hitting surface 51 of the golf club head, and a power source 31 supported by the golf club head cover 10 to electrically connect with the heating plate 33, wherein when the power source 31 is activated, the heating plate 33 is arranged to be heated up by the power source 31, wherein the heat generated by the heating plate 33 is transferred to the hitting surface 51 of the golf club head through the heating pocket 24 so as to heat up and maintain the hitting surface 51 to an predetermined elevated temperature for achieving an optimal performance when the hitting surface 51 hits a golf ball.

Figure 3:
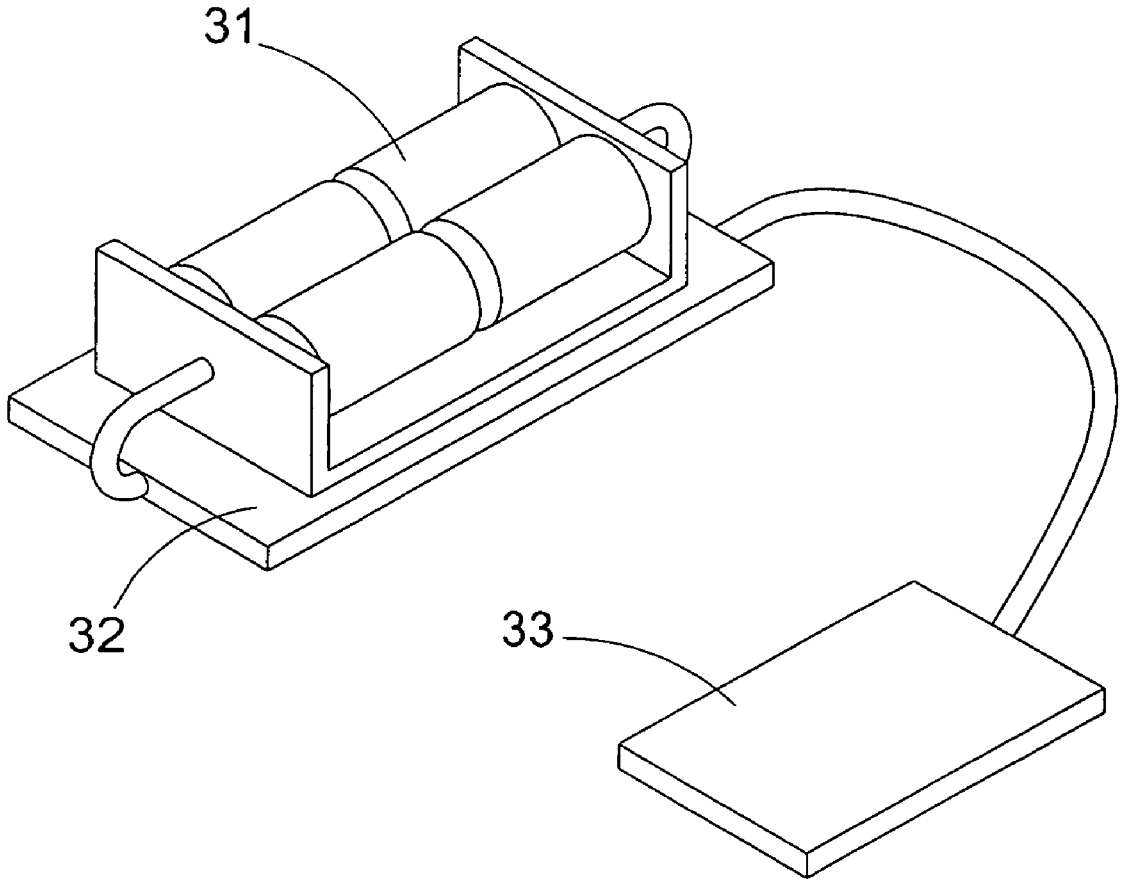
FIG. 3 is a perspective view of the temperature controlling device according to the above preferred embodiment of the present invention.
Figure 4:
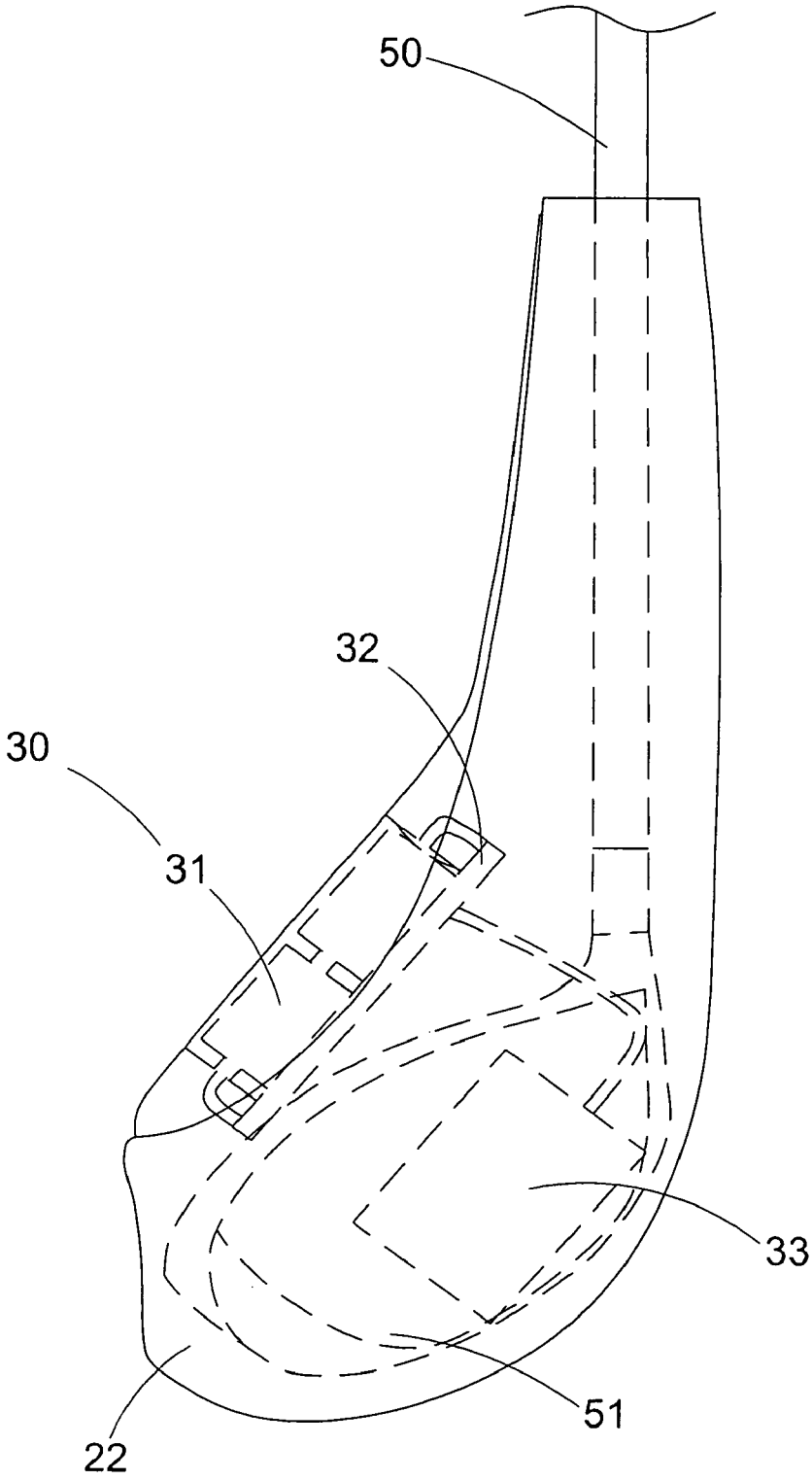
FIG. 4 is another schematic diagram of the golf club head cover according to the above preferred embodiment of the present invention.

According to the preferred embodiment of the present invention, the main housing 20, having a top portion 26 and a bottom portion 27 defining the receiving cavity 21 therewithin, is made of soft padding materials surrounding an outside of the main housing 20 which creates the cavity 21 for inserting an object (such as the golf club 50) which requires heating or cooling. As shown in FIG. 4 of the drawings, a top portion of a golf club 50 is inserted into the cavity 21 of the golf club head cover 10 for providing protection. The main housing 20 further has a heating side 22 and an opening side 23. As shown in FIG. 3 of the drawings, when the golf club 50 is inserted into the cavity 21 of the golf club head cover 10, a hitting surface 51 of the golf club 50 aligns with the heating side 22 of the main housing 20 of the golf club head cover 10.

Figure 6:
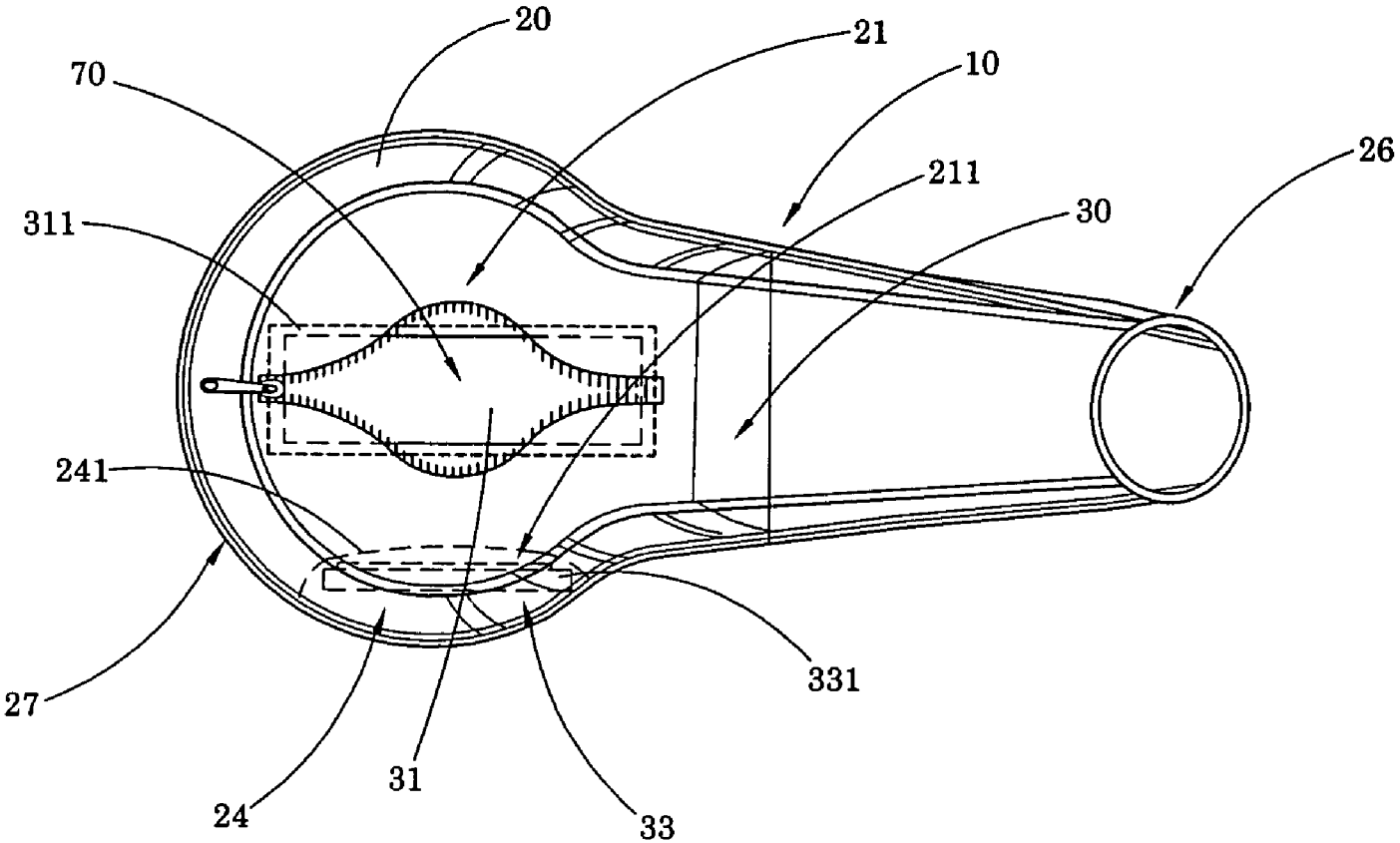
FIG. 6 is a top view of the golf club head cover according to the above preferred embodiment of the present invention.
Figure 7:
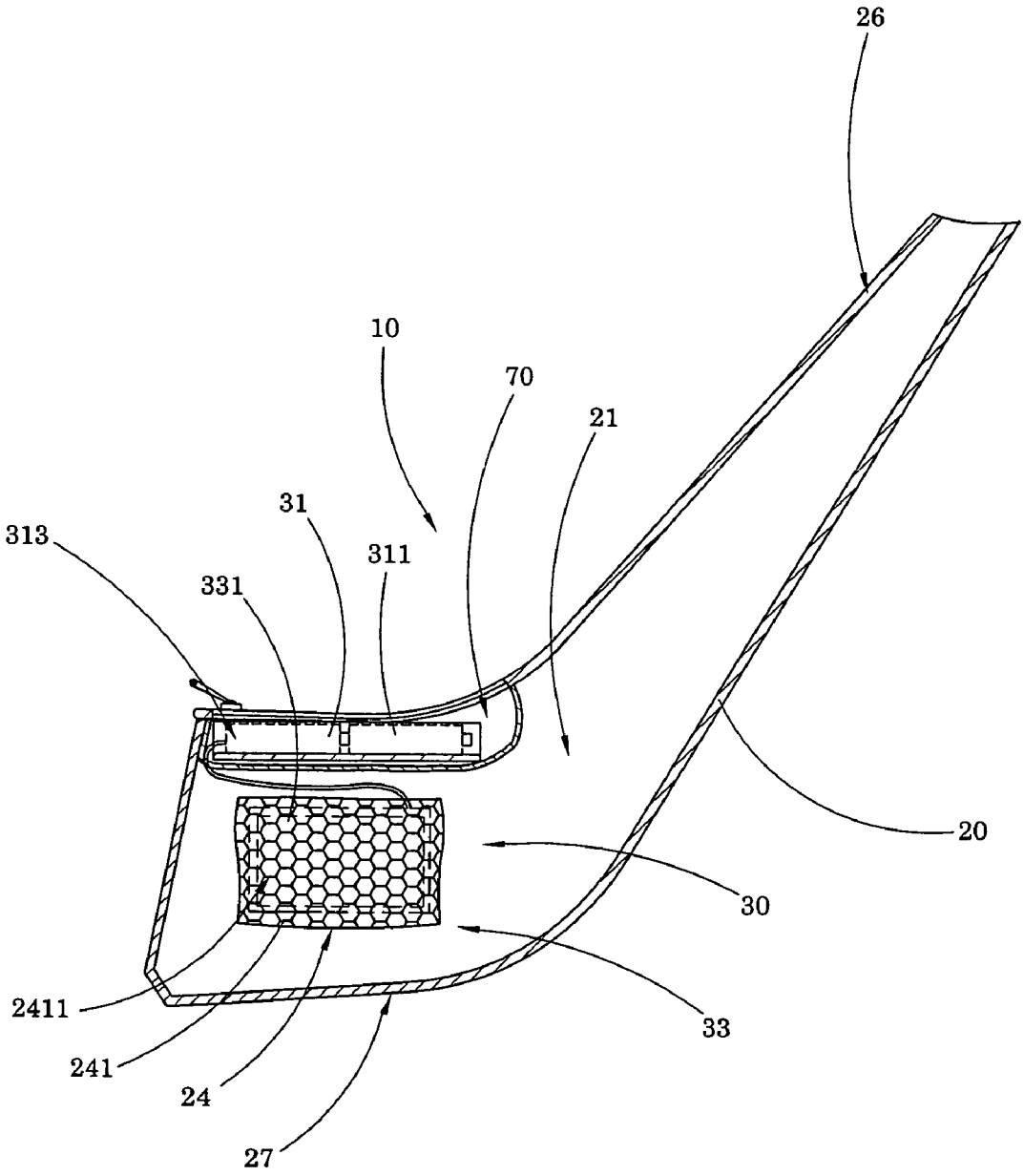
FIG. 7 is a side view of the golf club head cover according to the above preferred embodiment of the present invention.
Figure 8:
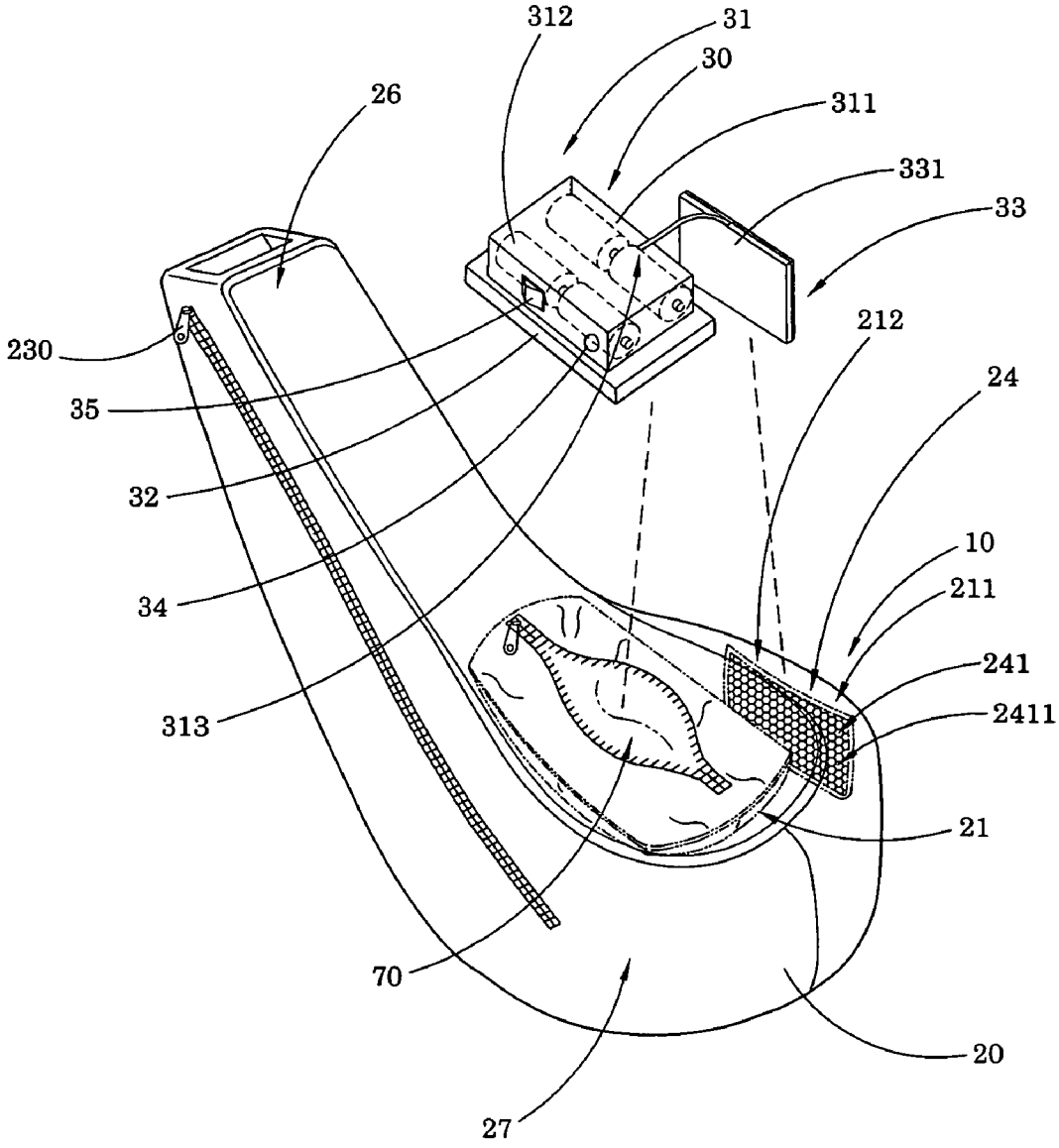
FIG. 8 is an exploded perspective view of the golf club head cover according to the above preferred embodiment of the present invention.

The heating pocket 24 is disposed in the receiving cavity 21 of the main housing 20, and comprises a pocket holder 241 attached to an inner surface of the receiving cavity 21 at a position aligning with the hitting surface 51 to define a heating cavity 211 for holding the hitting plate 33, and a pocket opening 212 communicating the heating cavity 211 and the receiving cavity 21. It is worth mentioning that the pocket opening 212 may be selectively sealed for blocking unwanted physical access to the heating cavity 211 from the receiving cavity 21. As shown in FIG. 6 to FIG. 7 of the drawings, the pocket holder 241 comprises a flexible fabric preferably having a plurality ventilating holes 2411 formed thereon for thermally communicating the heating cavity 24 with the receiving cavity 21.

Figure 5:
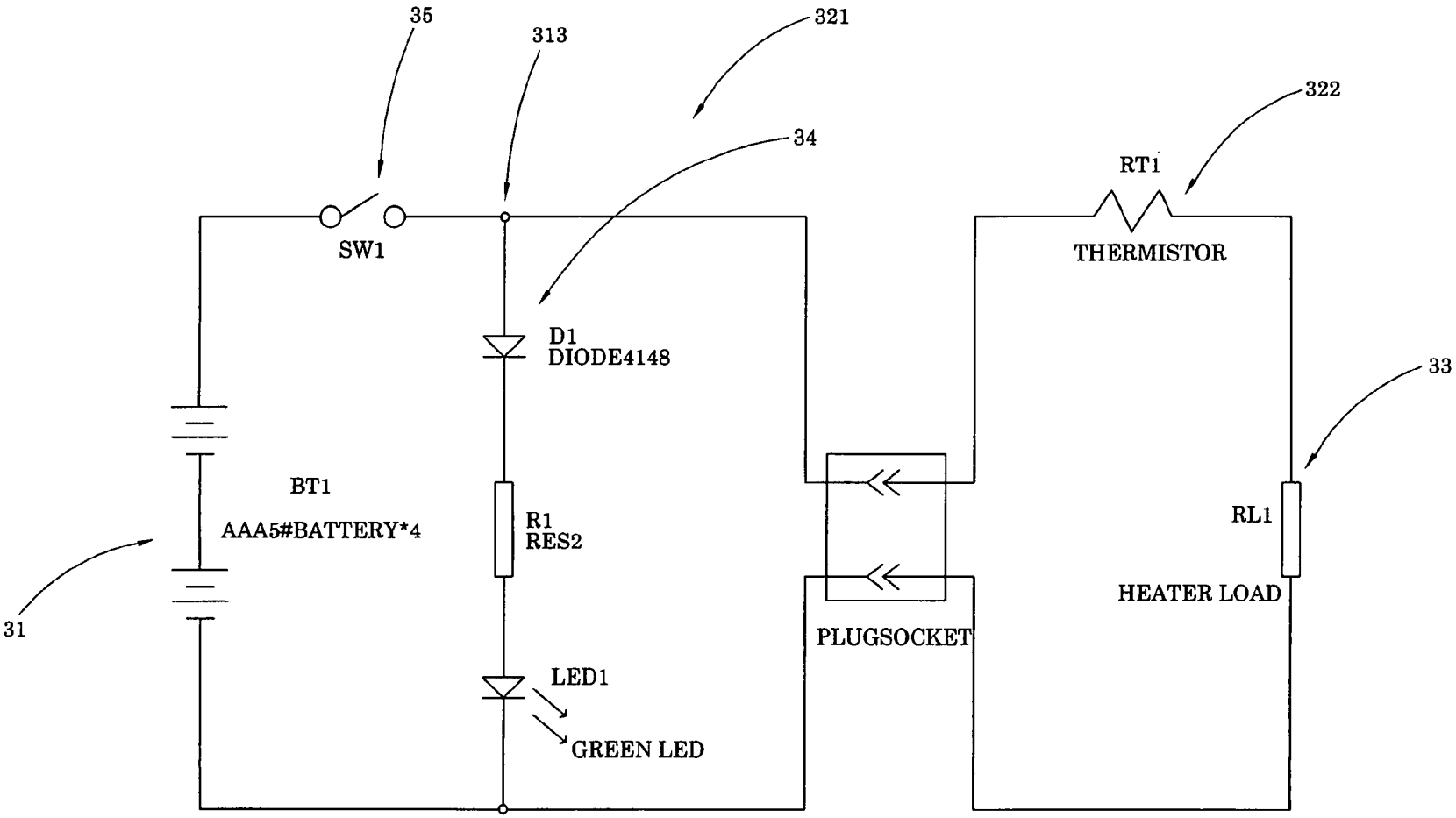
FIG. 5 is a circuit diagram of the golf club head cover according to the above preferred embodiment of the present invention.

The temperature controlling device 30 further comprises a circuit board 32 for controlling an operation for heating plate 33 as powered by the power source 31. More specifically, the power source 31, the circuit board 32, and the heating plate 33 are all electrically connected with respective to each other as shown in FIG. 3 and FIG. 5 of the drawings. The power source 31 of the temperature controlling device 30 comprises a plurality of batteries 312 providing electrical power for operating the heating plate 33 for a period of four to five hours. The power source 30 could also be connected to any external power source for providing the electrical power.

The circuit board 32 comprises a power circuitry 321 to provide a controlled electrical signal for the heating plate 33 so that it can be activated for heating the hitting surface 51 of the golf club head. The circuit board 32 further comprises a temperature detecting device 322 for detecting a current temperature of the hitting surface 51 of the golf club 50 such that the power circuitry 321 is capable of determining if the hitting surface 51 requires heating or not for promptly and accurately responding to a temperature deficiency of the hitting surface 51 (i.e. the deficiency between the current temperature and the elevated temperature). A best temperature range for the hitting surface 51 of the golf club 50 is 43° C. to 55° C. So for example, when the temperature detecting device 322 of the circuit board 32 detects that the temperature of the hitting surface 51 is 25° C. (room temperature), the power circuitry 321 of the circuit board 32 will activate the heating plate 33 to heat up the hitting surface 51 of the golf club 50. According to the preferred embodiment of the present invention, it takes approximately 14 minutes for the initial heating to reach 55° C. from 25° C. (room temperature). As mentioned above, the heating plate 33 is disposed firmly inside the heating pocket 24 within the main housing 20. Moreover, the temperature controlling device 30 further comprises a control switch 35 supported by the main housing 20 to electrically connect with the circuit board 32 for selectively activating the heating plate 33 in a controlled manner. Thus, a user is able to turn on or off the heating plate 33 by switching the control switch 35. Note that the position of the control switch 35 can vary depending on the circumstances in which the present invention is used and manufactured. For example, the control switch 35 can be provided directly on the circuit board 32, or it can be electrically extended to provide on the main housing 20 out of the receiving cavity 21. Similarly, the control switch 35 can also be extended from the circuit board 32 to be received within the receiving cavity 21 for better protection of the control switch 35. Note that the temperature detecting device 322 can be a conventional temperature sensor, such as a thermistor, for detecting the temperature of the hitting surface 51.

The power source 31 comprises a battery holder for holding a replaceable battery 312 in position, and a terminal 313 extended from the battery holder to the heating device for electrically connecting the replaceable battery 312 with the heating device when the replaceable battery 312 is held at the battery holder.

According to the preferred embodiment of the present invention, the power source 31 comprises a battery rack 311, having a plurality of battery terminals, supported within the receiving cavity 21 to electrically connect with the circuit board 32 and the heating plate 33, and a plurality of the replaceable batteries 312 replaceably installed at the battery rack 311 for providing electricity to the circuit board 32 and the heating plate 33. It is worth mentioning that the batteries 312 can be embodied as regular dry cells, or rechargeable batteries which are capable of supplying electrical power to heat up the heating plate 33 as controlled by the circuit board 32. As shown in FIGS. 1-8 of the drawings, the battery rack 311 is received within the receiving cavity 21 and is spacedly apart from the heat plate 33 so that a size of the heating pocket 24 can be minimized to facilitate accurate alignment with the hitting surface 51 when the golf club 50 or at least the golf club head is contained within the receiving cavity.

Moreover, the temperature controlling device 30 further comprises a heating indicator 34 provided on the battery rack 311 of the power source 31 for indicating a heating status of the hitting surface 51. For example, when the power source 31 is heating up the hitting surface 51 (i.e. the temperature of the heating plate 33 is increasing), a predetermined color is indicated on the heating indicator 34 for informing the user that the temperature controlling device 30 has been activated and is heating up the hitting surface 51 through the heating plate 33. According to the preferred embodiment of the present invention, the heating indicator 34 is embodied as a LED adapted to generate illumination to indicator a heating status of the heating plate 33. Furthermore, the heating plate 33 comprises a silicon or silver heat transfer panel 331 wherein heat is transferred to the hitting surface 51 through the silicon or silver heat transfer panel 331.

As shown in FIG. 1 of the drawings, the opening side 23 of the main housing 10 further comprises a zipper 230 for opening and closing the cavity 21 for inserting the object that requires heating. According to the preferred embodiment of the present invention, when the zipper 230 is opened, it enlarges the cavity 21 such that the golf club 50 can be easily inserted inside the golf club head cover 10. After the insertion, the zipper 230 is closed thus allowing the golf club head cover 10 to completely surround and protect the top portion of the golf club 50. The soft padding materials of the main housing 10 prevent the top portion of the golf club 50 to be damaged from physical impacts.

Figure 2:
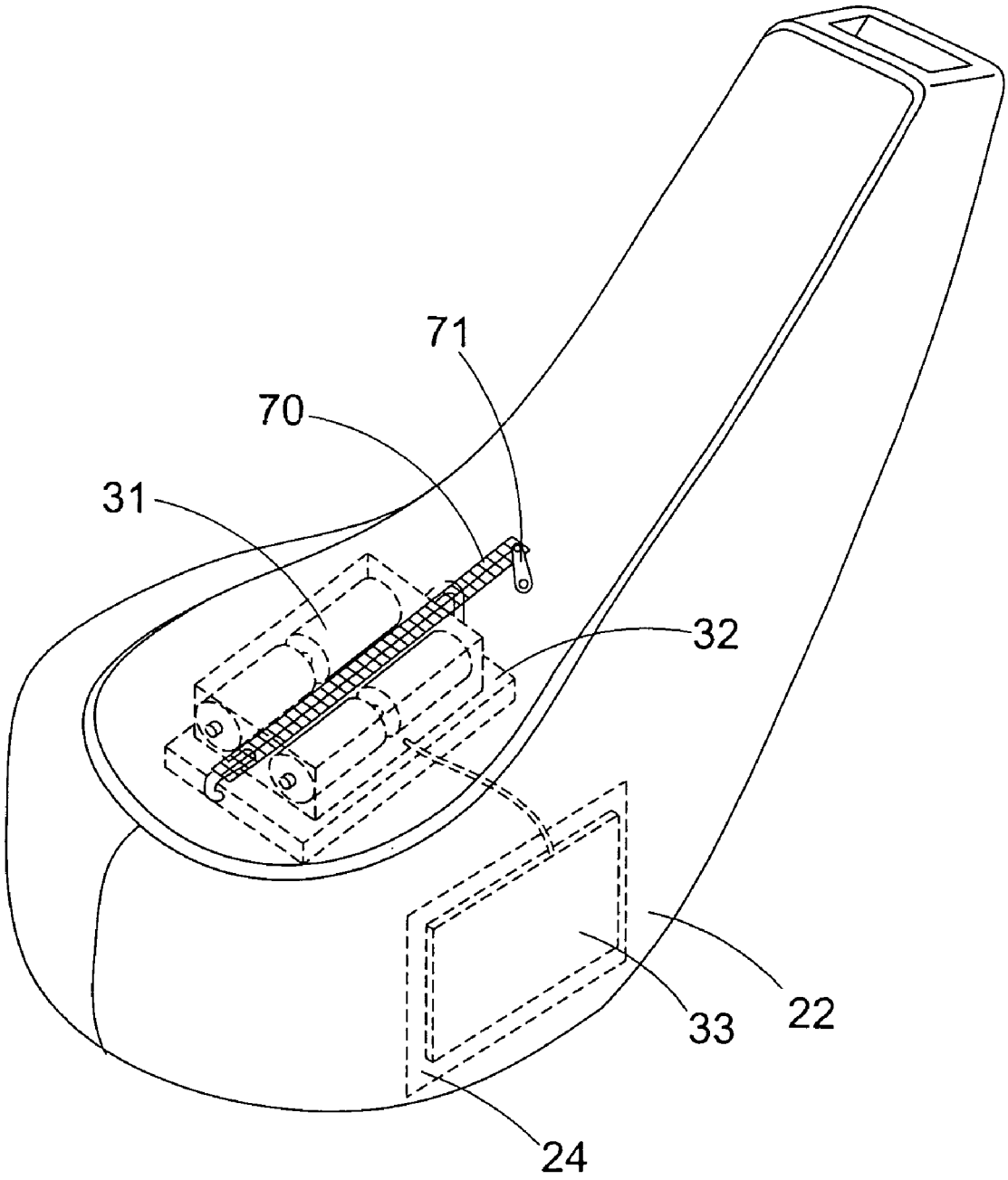
FIG. 2 is a schematic diagram of a golf club head cover according to the above preferred embodiment of the present invention.

According to the preferred embodiment of the present invention as shown in FIG. 1 and FIG. 2 of the drawings, the outside of the main housing 10 further comprises a battery pocket 70 to contain the batteries of the power source 31 and the circuit board 32 therewithin. The battery pocket 70 further comprises a zipper 71 to open and close the battery pocket 70 for inserting the power source 31 and the circuit board 32.

Figure 9:
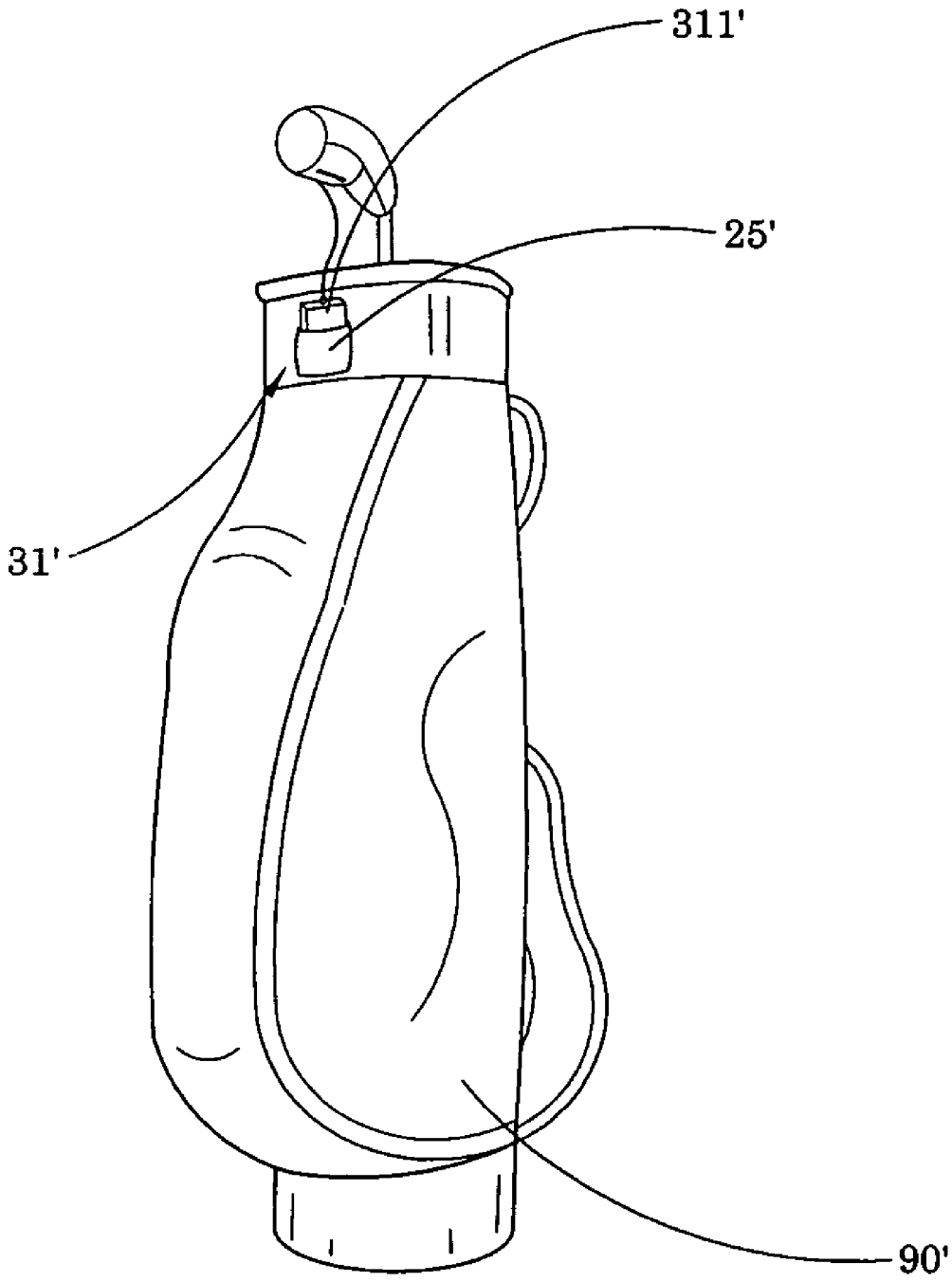
FIG. 9 is a first alternative mode of the golf club head cover according to the above preferred embodiment of the present invention.

Referring to FIG. 9 of the drawings, a first alternative mode of the golf club head cover 10' according to the preferred embodiment of the present invention is illustrated. The first alternative mode is similar to the preferred embodiment except that the golf club head cover of the present invention is used in conjunction with a golf bag 90'. According to the alternative mode, a golf bag 90 comprises a power source pocket 25' provided on an outer surface thereon wherein the battery rack 311' of the power source 31' and the control switch 35 are extended from the receiving cavity to dispose in the power source pocket 25', so that a user is able conveniently replace the batteries 312 and control the operation of the heating plate 33 without accessing the receiving cavity 21. Moreover, a size of the receiving cavity 21 can also be minimized because the battery rack 311' and the batteries 312 are no longer disposed within the receiving cavity 21. Finally, it is worth mentioning that control switch 35 may be provided at any position of the golf bag 90 so that the present invention can be used in a wide range of situations and for different kinds of users. The experimental results of the golf club head cover for various working conditions and time are shown as follows, where time is period over which the heating plate is heated with a predetermined current, HPT stands for temperature of the heat plate 33, and GT stands for temperature of the gold club head.

TABLE 1

| Time (min) | HPT (° C.) | GT (° C.) |
|---|---|---|
| 0:02 | 37 | 18 |
| 0:04 | 40 | 20 |
| 0:06 | 42 | 21 |
| 0:08 | 44 | 23 |
| 0:10 | 45 | 24 |
| 0:12 | 46 | 25 |
| 0:14 | 47 | 26 |
| 0:16 | 49 | 27 |
| 0:18 | 49 | 28 |
| 0:20 | 50 | 29 |
| 0:22 | 51 | 30 |
| 0:24 | 52 | 31 |
| 0:26 | 53 | 32 |
| 0:28 | 53 | 32 |
| 0:30 | 54 | 33 |
| 0:32 | 54 | 34 |
| 0:34 | 55 | 35 |
| 0:36 | 56 | 35 |
| 0:38 | 56 | 36 |
| 0:40 | 57 | 36 |
| 0:42 | 57 | 37 |
| 0:44 | 58 | 38 |
| 0:46 | 59 | 38 |
| 0:48 | 60 | 39 |
| 0:50 | 60 | 39 |
| 0:52 | 60 | 40 |
| 0:54 | 60 | 40 |
| 0:56 | 61 | 41 |
| 0:58 | 61 | 41 |
| 1:00 | 61 | 42 |
| 1:02 | 61 | 42 |
| 1:04 | 62 | 42 |
| 1:06 | 62 | 43 |
| 1:08 | 62 | 43 |
| 1:10 | 62 | 44 |
| 1:12 | 63 | 44 |
| 1:14 | 63 | 44 |

TABLE 1-continued

| | | |
|---|---|---|
| 1:16 | 63 | 45 |
| 1:18 | 64 | 45 |
| 1:20 | 64 | 45 |
| 1:22 | 64 | 46 |
| 1:24 | 64 | 46 |
| Time (min) | HPT (38° C.) | GT (° C.) |
| 1:26 | 64 | 46 |
| 1:28 | 65 | 46 |
| 1:30 | 65 | 47 |
| 1:32 | 65 | 47 |
| 1:34 | 65 | 47 |
| 1:36 | 65 | 47 |
| 1:38 | 66 | 48 |
| 1:40 | 66 | 48 |
| 1:42 | 66 | 48 |
| 1:44 | 66 | 48 |
| 1:46 | 66 | 48 |
| 1:48 | 66 | 49 |
| 1:50 | 66 | 49 |
| 1:52 | 66 | 49 |
| 1:54 | 67 | 49 |
| 1:56 | 67 | 49 |
| 1:58 | 67 | 49 |
| 2:00 | 67 | 49 |
| 2:02 | 67 | 50 |
| 2:04 | 67 | 50 |
| 2:06 | 67 | 50 |
| 2:08 | 68 | 50 |
| 2:10 | 68 | 50 |
| 2:12 | 69 | 50 |
| 2:14 | 69 | 50 |
| 2:16 | 69 | 50 |
| 2:18 | 69 | 50 |
| 2:20 | 69 | 50 |
| Time (min) | HPT (4466° C.) | GT (° C.) |
| 2:22 | 69 | 50 |
| 2:24 | 69 | 50 |
| 2:26 | 69 | 50 |
| 2:28 | 69 | 50 |
| 2:30 | 69 | 50 |
| 2:32 | 69 | 50 |
| 2:34 | 69 | 50 |
| 2:36 | 69 | 50 |
| 2:38 | 69 | 50 |
| 2:40 | 70 | 50 |
| 2:42 | 70 | 50 |
| 2:44 | 70 | 50 |
| 2:46 | 70 | 50 |
| 2:48 | 70 | 50 |
| 2:50 | 70 | 50 |
| 2:52 | 70 | 50 |
| 2:54 | 70 | 50 |
| 2:56 | 70 | 50 |

Table 2 illustrates the heating of the golf club head with high temperature, where time is period over which the heating plate is heated with a predetermined current, HPT stands for temperature of the heat plate 33, and GT stands for temperature of the gold club head.

TABLE 2

| Time (min) | HPT (° C.) | GT (° C.) |
|---|---|---|
| 0:02 | 78 | 29 |
| 0:04 | 78 | 36 |
| 0:06 | 88 | 42 |
| 0:08 | 88 | 46 |
| 0:10 | 89 | 51 |
| 0:12 | 90 | 54 |
| 0:14 | 91 | 56 |
| 0:16 | 92 | 58 |
| 0:18 | 93 | 60 |

TABLE 2-continued

| Time (min) | HPT (° C.) | GT (° C.) |
|---|---|---|
| 0:20 | 94 | 62 |
| 0:22 | 95 | 64 |
| 0:24 | 96 | 66 |
| 0:26 | 97 | 67 |
| 0:28 | 98 | 69 |
| 0:30 | 100 | 70 |
| 0:32 | 100 | 72 |
| 0:34 | 101 | 73 |
| 0:36 | 102 | 74 |
| 0:38 | 104 | 75 |
| 0:40 | 104 | 76 |
| 0:42 | 105 | 77 |
| 0.44 | 106 | 78 |

Figure 10:
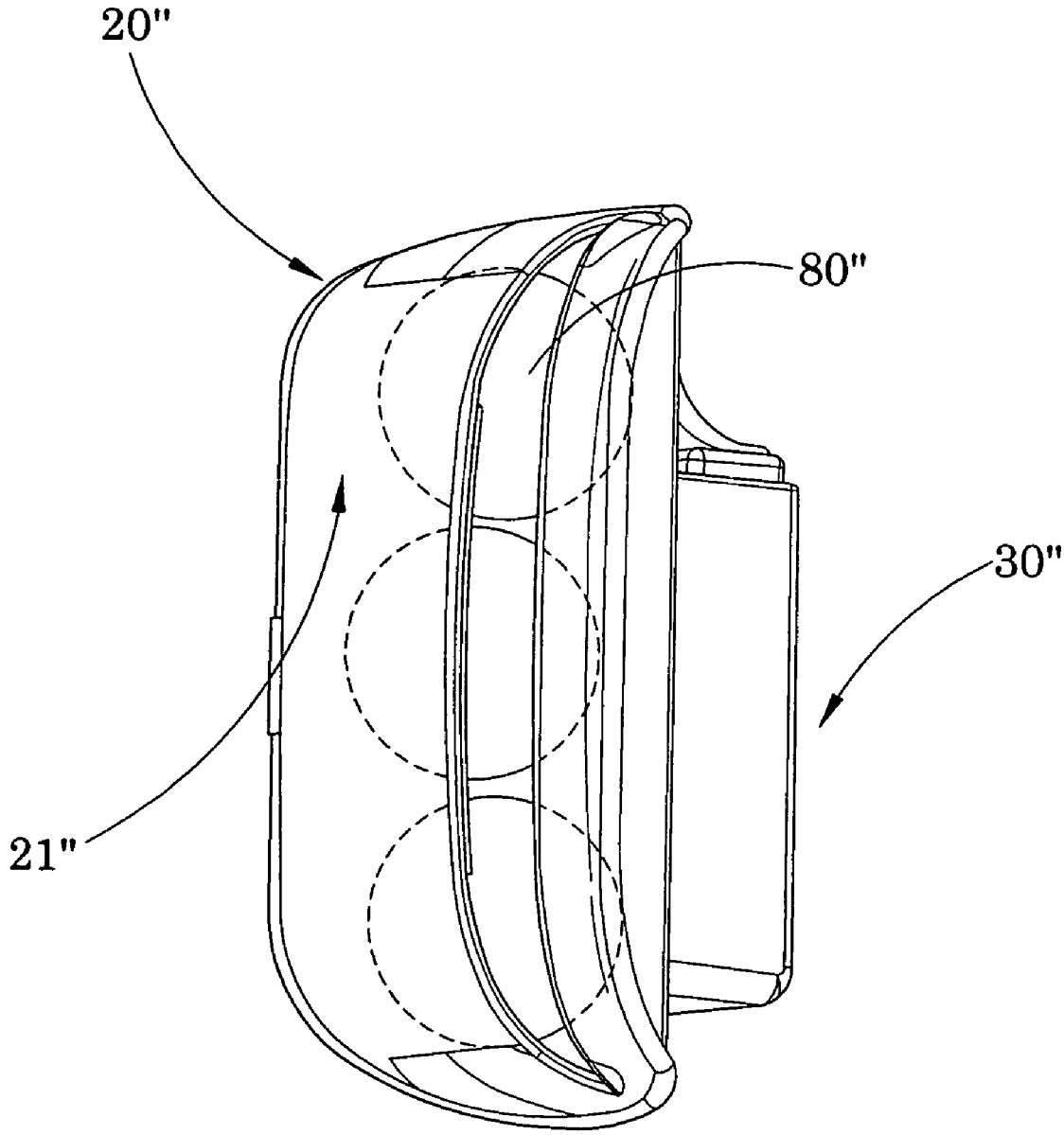
FIG. 10 is a perspective view of a second alternative mode of the golf club head cover according to the above preferred embodiment of the present invention.
Figure 11:
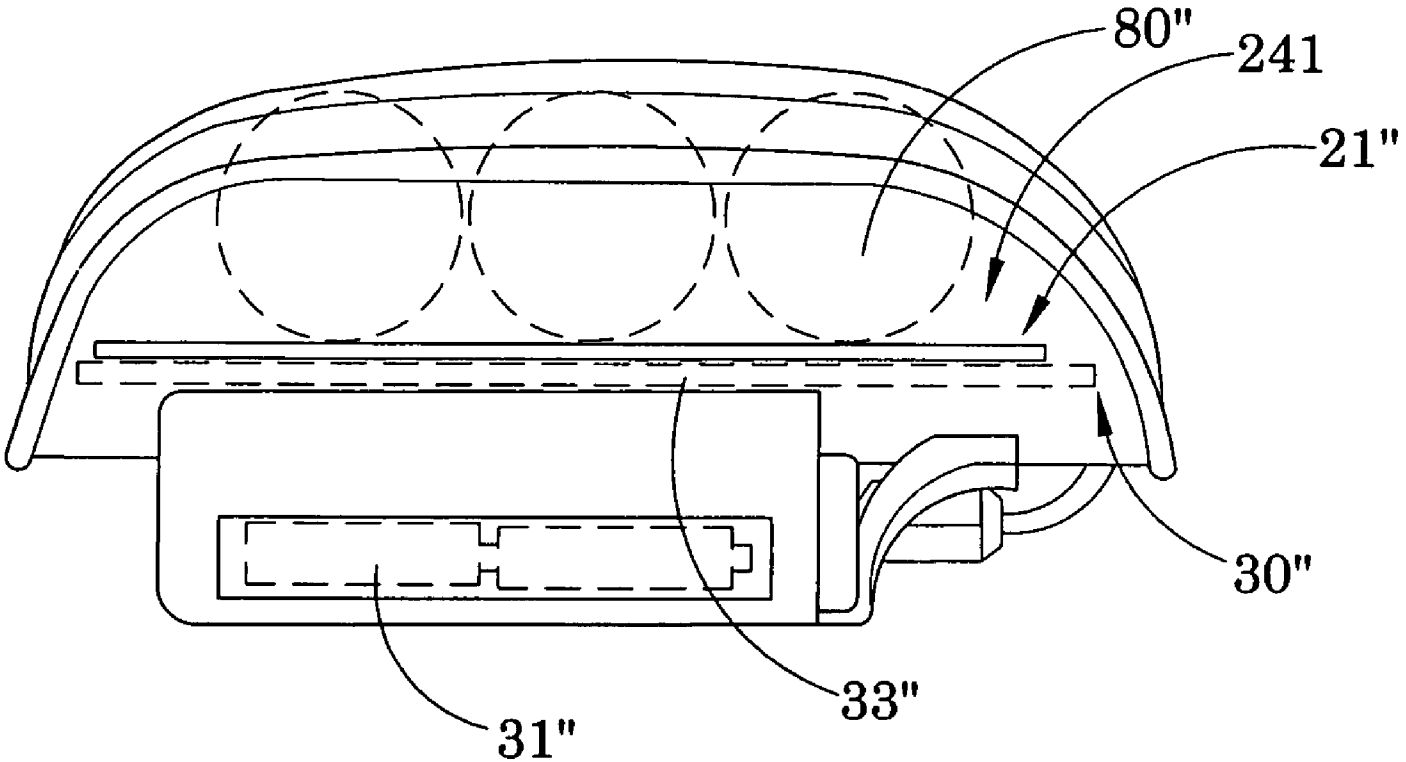
FIG. 11 a schematic diagram of a second alternative mode of the golf club head cover according to the above preferred embodiment of the present invention.

Referring to FIG. 10 to FIG. 11 of the drawings, a second alternative mode of the gold club head cover according to the preferred embodiment of the present invention is illustrated. The second alternative mode is similar to the preferred embodiment except that the golf club head cover can also be embodied for containing and gently heating golf balls 80". More specifically, the receiving cavity 21" of the main housing 20" is adapted to receive a predetermined number of golf balls 80", wherein the temperature controlling device 30" is disposed within the receiving cavity 21" for heating the golf balls 80". Thus, the heating plate 33" and the power source 31" are disposed at a lower portion of the receiving cavity 21" while the predetermined number of golf balls 80" is disposed in the receiving cavity 21" to thermally communicate with the heating plate 33". When the power source 31" is activated, the heating plate 33" is arranged to be heated up by the power source 31", wherein the heat generated by the heating plate 33" is transferred to the golf ball 80" through the heating pocket 24" so as to heat up and maintain the golf ball 80" at an predetermined elevated temperature for achieving an optimal performance when the golf ball 80" is being hit.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A golf club head cover for a golf club head having a hitting surface, comprising:

a main housing having a cavity with a predetermined shape and size for receiving said golf club head therein at a position that said hitting surface of said golf club head is retained at a predetermined orientation; and a temperature controlling device, which comprises:

a heating device supported in said main housing for aligning with said hitting surface of said gold club head; and a power source electrically coupling with said heating device, wherein when said power source is activated, said heating device generates heat towards said hitting surface of said golf club head to maintain said hitting surface of said golf club head at an optimal hitting temperature for optimal performance thereof.

2. The golf club head cover, as recited in claim 1, wherein said heating device comprises a heating plate electrically coupling with said power source for heat generation, and a heat transfer panel overlapped with said heating plate for transmitting said heat from said heating plate to said hitting surface of said golf club head so as to prevent said hitting surface thereof from being burnt.

3. The golf club head cover, as recited in claim 2, wherein said heat transfer panel is made of silver.

4. The golf club head cover, as recited in claim 1, wherein said main housing further comprises a heating pocket, receiving said heating device therein, provided in said cavity at a position that said hitting surface of said golf club head is aligned with said heating pocket.

5. The golf club head cover, as recited in claim 3, wherein said main housing further comprises a heating pocket, receiving said heating device therein, provided in said cavity at a position that said hitting surface of said golf club head is aligned with said heating pocket.

6. The golf club head cover, as recited in claim 1, wherein said temperature controlling device further comprises a temperature detecting device supported within said cavity at a position close to said hitting surface of said golf club head for detecting a current temperature thereof, and a power circuitry operatively controlling said heating device for heat generation for promptly and accurately responding to a temperature deficiency of said hitting surface from said optimal hitting temperature.

7. The golf club head cover, as recited in claim 3, wherein said temperature controlling device further comprises a temperature detecting device supported within said cavity at a position close to said hitting surface of said golf club head for detecting a current temperature thereof, and a power circuitry operatively controlling said heating device for heat generation for promptly and accurately responding to a temperature deficiency of said hitting surface from said optimal hitting temperature.

8. The golf club head cover, as recited in claim 5, wherein said temperature controlling device further comprises a temperature detecting device supported within said cavity at a position close to said hitting surface of said golf club head for detecting a current temperature thereof, and a power circuitry operatively controlling said heating device for heat generation for promptly and accurately responding to a temperature deficiency of said hitting surface from said optimal hitting temperature.

9. The golf club head cover, as recited in claim 1, wherein said temperature controlling device further comprises a control switch supported by said main housing to electrically connect with said power source for selectively activating said heating device in a controlled manner.

10. The golf club head cover, as recited in claim 5, wherein said temperature controlling device further comprises a control switch supported by said main housing to electrically connect with said power source for selectively activating said heating device in a controlled manner.

11. The golf club head cover, as recited in claim 8, wherein said temperature controlling device further comprises a control switch supported by said main housing to electrically connect with said power source for selectively activating said heating device in a controlled manner.

12. The golf club head cover, as recited in claim 1, wherein said power source comprises a battery holder for holding a replaceable battery in position, and a terminal extended from said battery holder to said heating device for electrically connecting said replaceable battery with said heating device when said replaceable battery is held at said battery holder.

13. The golf club head cover, as recited in claim 8, wherein said power source comprises a battery holder for holding a replaceable battery in position, and a terminal extended from said battery holder to said heating device for electrically connecting said replaceable battery with said heating device when said replaceable battery is held at said battery holder.

14. The golf club head cover, as recited in claim 11, wherein said power source comprises a battery holder for holding a replaceable battery in position, and a terminal extended from said battery holder to said heating device for electrically connecting said replaceable battery with said heating device when said replaceable battery is held at said battery holder.

15. The golf club head cover, as recited in claim 1, wherein said main housing further comprises a power source pocket provided on an outer surface thereof for receiving said power source in said power source pocket for easy accessing.

16. The golf club head cover, as recited in claim 11, wherein said main housing further comprises a power source pocket provided on an outer surface thereof for receiving said power source in said power source pocket for easy accessing.

17. The golf club head cover, as recited in claim 14, wherein said main housing further comprises a power source pocket provided on an outer surface thereof for receiving said power source in said power source pocket for easy accessing.

18. The golf club head cover, as recited in claim 1, wherein said temperature controlling device further comprises a heating indicator electrically coupling with said heating device for indicating a heating status of said hitting surface of said golf club.

19. The golf club head cover, as recited in claim 11, wherein said temperature controlling device further comprises a heating indicator electrically coupling with said heating device for indicating a heating status of said hitting surface of said golf club.

20. The golf club head cover, as recited in claim 17, wherein said temperature controlling device further comprises a heating indicator electrically coupling with said heating device for indicating a heating status of said hitting surface of said golf club.

* * * * *